United States Patent [19]

Ward

[11] 3,961,664

[45] June 8, 1976

[54] SPLIT MOULDS AND CARRIERS THEREFOR

[75] Inventor: John David Ward, Stourport, England

[73] Assignee: Precision Engineering (Worcester) Limited, Warndon, England

[22] Filed: Aug. 22, 1975

[21] Appl. No.: 607,044

[30] Foreign Application Priority Data

Sept. 5, 1974 United Kingdom..... 38804/74

[52] U.S. Cl...... 164/343; 249/170

[51] Int. Cl.[2]..... B22D 17/10

[58] Field of Search..... 164/343; 249/170

[56] References Cited

UNITED STATES PATENTS 3,224,049 12/1965 Woods et al..... 164/343

3,279,004 10/1966 Hartman et al..... 164/343

*Primary Examiner*—Travis S. McGehee

*Attorney, Agent, or Firm*—Young & Thompson

[57] ABSTRACT

Support members for separable cooperating parts of a split mould are in pin-and-slot connection with one of the support members having spaced parallel projections or rollers running in a common slot in the other support member. The slot is of curvate form to determine the path of relative movement of the support members and piston and cylinder means is provided to effect this movement.

5 Claims, 3 Drawing Figures

SPLIT MOULDS AND CARRIERS THEREFOR

FIELD OF THE INVENTION

This invention relates to split moulds, and to mould carriers therefor.

BACKGROUND OF THE INVENTION

U.S. Pat. No. 3,782,679, which issued on the January 1, 1974, describes a split mould having a base supporting a base mould part, a swinging arm carrying an upper mould part capable of being lowered on to the base mould part and of being raised and swung backwardly clear thereof for access to the base mould part and pin-and-slot hinging means located between said base and said arm clear of the mould parts and to the rear thereof.

The swinging arm is movable manually between its raised and lowered positions and thus there is a limit to the size of mould which can be treated in this way. It is accordingly an object of the invention to facilitate the handling of large mould parts.

SUMMARY OF THE INVENTION

Piston and cylinder means act between the base and the swinging arm, the piston and cylinder means being arranged to act substantially horizontally with the cylinder attached to the base and the piston attached to a link adjacent one end thereof, the other end of the link being attached to the swinging arm.

DESCRIPTION OF THE PREFERRED EMBODIMENT

Figure 1:
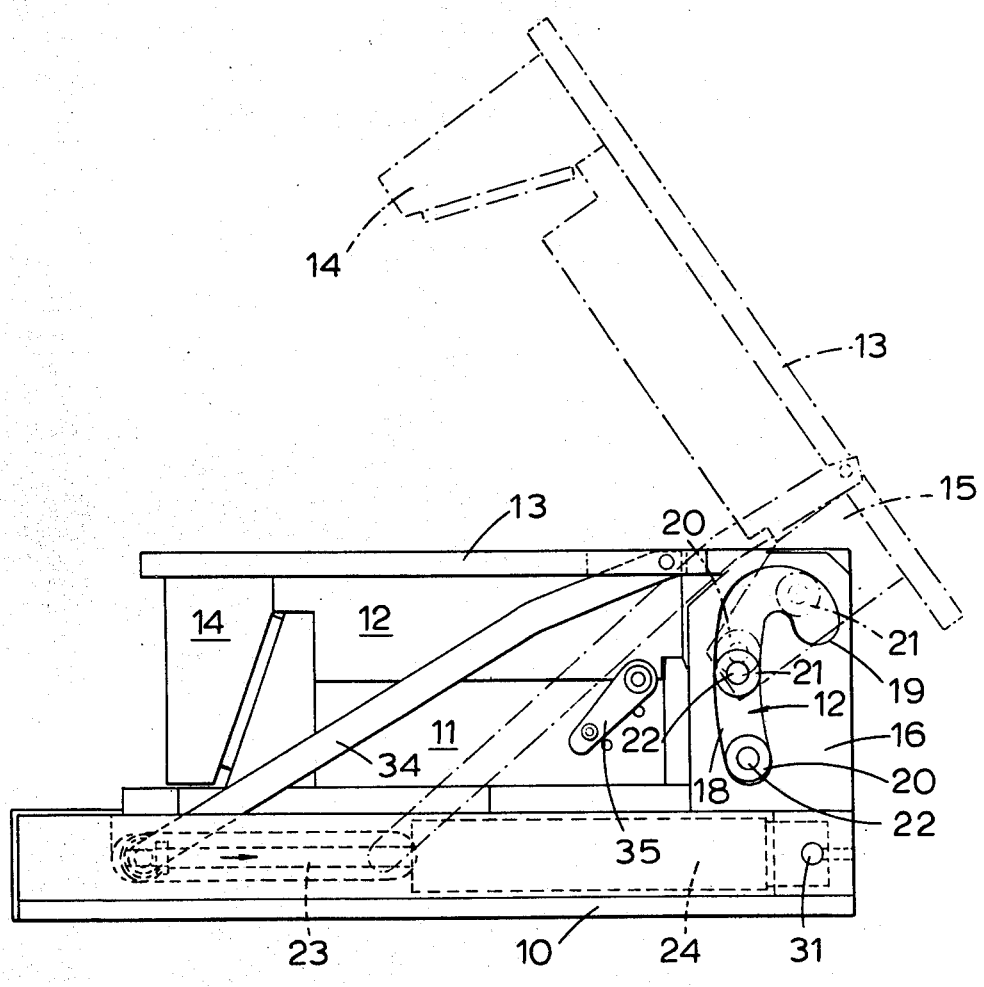
FIG. 1 is a side view of the mould in the closed position but showing the mould carrier in broken lines in its open position.
Figure 3:
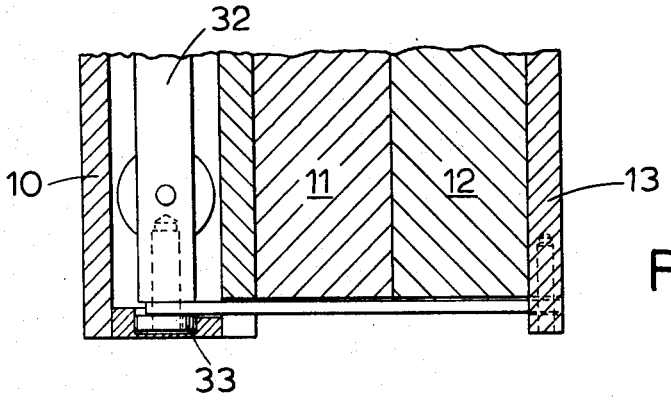
FIG. 3 is a sectional view along the line A—A in FIG. 2.
Figure 2:
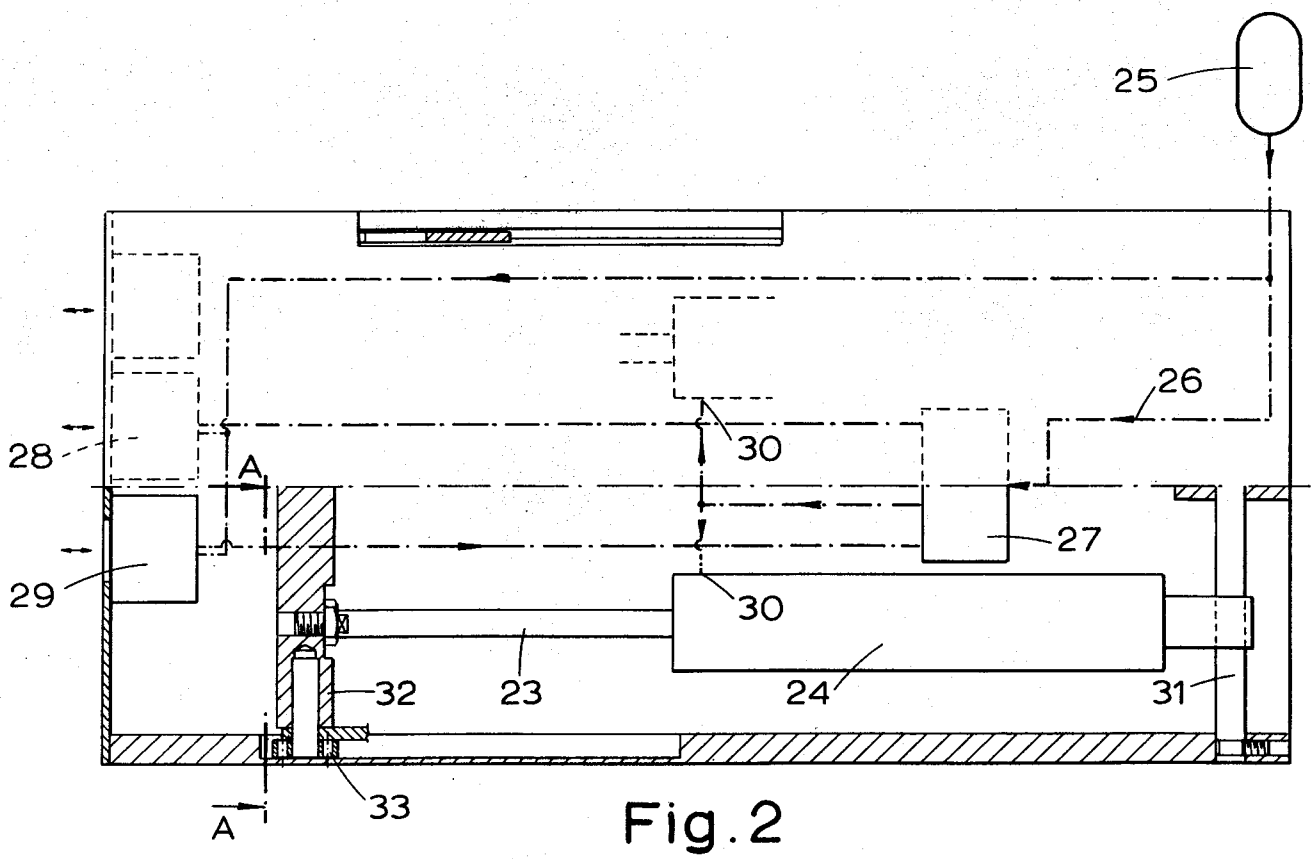
FIG. 2 is a plan view of the lower portion of the mould.

As shown in the drawings, a mould carrier comprises a base plate 10 carrying the main lower part 11 of a split mould, this lower part 11 facially engaging an upper mould part 12 carried on a second plate 13 constituting a swinging arm. Side elements (not shown) of the mould are mounted on the base plate 10 in slides and held by studs which move in slots in the manner shown in the drawings accompanying U.S. Pat. No. 3,782,679. The mould is closed to provide a cavity between the faces of the mould parts 11 and 12 and of the side elements by sliding the side elements into contact with the lower mould part 11 and lowering the swinging arm 13 from its open position shown in broken lines in FIG. 1 into its closed position. Wedging blocks 14 and 15 are fixed to the swinging arm 13 to hold the side elements firmly against the sides of the mould parts 11 and 12 in the closed state of the mould.

The swinging motion of the arm 13 is provided for by a linkage in the following way. One 15 of the wedging blocks on the swinging arm 13 fits closely between a pair of cheeks 16 extending upwardly from the base plate 10. The cheeks 16 have aligned through slots 17 with arcuate portions 18 of a preselected radius of curvature and the top end portion 19 of each of the slots 17 curves downwardly with a relatively small radius of curvature to provide a somewhat hook-shaped formation. On each side of the wedging block 15, two spaced rollers 20 and 21 are attached by pins 22 and the rollers 20 and 21 ride in the slots 17 in the cheeks 16. When the two rollers 20 and 21 at each side lie in the arcuate portions 18 of the slots 17, the swinging arm 13 is constrained to angular motion about that axis outside the structure which contains the centres of curvature of the arcuate portions of the slots 17. Hence the motion of the swinging arm 13 is effectively that of a long radius arm. When the swinging arm or plate 13 is fully raised to open the mould, the uppermost roller 21 on each side of the block can drop into the sharply curved end portion 19 of the corresponding slot 17 so that the swinging arm 13 is held in the raised position.

Movement of the swinging arm or plate 13 between its lower and fully raised positions is effected by means of a pair of pneumatic piston and cylinder mechanisms 23, 24 which are connected to a common compressed air supply 25 by a line 26 containing a valve block 27. The valve block 27 is operable by means of a pair of push-button-operated switches 28 and 29 to effect either retraction or extension of the pistons 23 and the air inlet 30 of each cylinder contains a restrictor to permit regulation of the rates at which the pistons 23 are either extended or retracted.

The cylinders 24 are mounted within the base of the mould carrier and are attached at their closed ends to a transversely extending cylinder support bar 31. A coupling bar 32 extends parallel to the support bar 31 and is connected to the free ends of the pistons 23. Roller bearings 33 are provided at the ends of the coupling bar 32 which is thus guided for horizontal reciprocal movement within the base, the outer races of the roller bearings engaging in guide tracks in the structure of the mould carrier.

A pair of links 34 are pivotally connected to the coupling bar 32, one adjacent each end thereof, and the other ends of the links 34 are connected to the swinging arm 13 adjacent the wedging block 15 carrying the rollers 21 and 22. Thus, as the coupling bar 32 is moved horizontally upon retraction of the pistons 23 between the limiting positions shown in FIG. 1, the swinging arm 13 will be raised and, as the pistons 23 are extended, the swinging arm 13 will be lowered. Raising and lowering of the swinging arm 13, i.e. opening and closing of the mould, can be effected merely by pressing the appropriate push-button. Opening and closing of the mould can thus be effected without any requirement for hoists or other lifting tackle and with the minimum of physical exertion on the part of the operator.

When the mould is closed, molten metal can be introduced into the mould cavity through an injection nozzle 35.

I claim:

1. In a split mould having a base supporting a base mould part, a swinging arm carrying an upper mould part capable of being lowered on to the base mould part and of being raised and swung backwardly clear thereof for access to the base mould part and pin-and-slot hinging means located between said base and said arm clear of the mould parts and to the rear thereof, said hinging means comprising at each side of the mould two spaced parallel and laterally projecting pins or pin-mounted rollers fixed to said arm and a cooperating guide slot extending upwardly from said base, the two pins or pin-mounted rollers riding in the guide slot to define a desired closing and opening path of said arm and upper mould part, the improvement comprising:

a. piston and cylinder means acting between the base and the swinging arm, b. the piston and cylinder means being arranged to act generally horizontally with the cylinder attached to the base and the piston attached to a link adjacent one end thereof, the other end of the link being attached to the swinging arm.

2. In a split mould according to claim 1, the improvement wherein:

two cylinders are arranged in parallel with the pistons thereof interconnected by a coupling bar to which a pair of links are connected, one adjacent each side of the base.

3. In a split mould according to claim 2, the improvement wherein:

the piston and cylinder mechanisms are connected to a common air supply via a control valve from which delivery lines extend to the two cylinders.

4. In a split mould according to claim 3, the improvement wherein:

restrictor means are contained in said delivery lines to control the rates of movement of the pistons relative to the cylinders and thus the rates of opening and closing of the mould parts.

5. In a split mould according to claim 3, the improvement wherein:

push-button operated means are providing for actuating the piston and cylinder mechanisms, one being pressed to open the mould parts and another being pressed to close the mould parts.

* * * * *